US007093930B2

(12) United States Patent
Yildirim et al.

(10) Patent No.: US 7,093,930 B2
(45) Date of Patent: Aug. 22, 2006

(54) MANAGING BUBBLES IN A FLUID-DELIVERY DEVICE

(75) Inventors: Ozgur Yildirim, Albany, OR (US); Gilbert G. Smith, Corvallis, OR (US); Mike Steed, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 198 days.

(21) Appl. No.: 10/666,749

(22) Filed: Sep. 18, 2003

(65) Prior Publication Data

US 2005/0062816 A1 Mar. 24, 2005

(51) Int. Cl.
*B41J 2/19* (2006.01)

(52) U.S. Cl. ..... 347/92

(58) Field of Classification Search ..... 347/85–87, 347/65, 92

See application file for complete search history.

(56) References Cited

U.S. PATENT DOCUMENTS 5,479,196 A 12/1995 Inada
5,600,349 A 2/1997 Keefe
5,700,315 A 12/1997 Wenzel
5,708,465 A * 1/1998 Morita et al. ..... 347/65
5,856,835 A 1/1999 Umeda et al.
5,886,715 A 3/1999 Fukuoka
5,900,889 A 5/1999 Tsukuda
6,033,060 A 3/2000 Minami
6,036,299 A 3/2000 Kobayashi et al.
6,042,218 A 3/2000 Nakahara
6,062,681 A 5/2000 Field et al.
6,145,952 A 11/2000 Sharma et al.
6,179,406 B1 1/2001 Ito et al.
6,193,355 B1 2/2001 Nakamura
6,213,581 B1 4/2001 Hasegawa et al.
6,276,778 B1 8/2001 Katayama
6,283,573 B1 9/2001 Nakamura
6,296,342 B1 10/2001 Oikawa
6,312,087 B1 11/2001 Imai et al.
6,312,089 B1 11/2001 Imai
6,334,662 B1 1/2002 Hollands
6,336,700 B1 1/2002 Hays et al.
6,357,852 B1 3/2002 Premnath et al.
6,382,764 B1 5/2002 Shimoda
6,386,677 B1 5/2002 Imai et al.
6,406,125 B1 6/2002 Jackson
6,457,802 B1 10/2002 Jackson
6,695,442 B1 * 2/2004 Kitahara ..... 347/92
6,752,489 B1 * 6/2004 Ohashi et al. ..... 347/65
2001/0028374 A1 10/2001 Ogawa et al.
2001/0050697 A1 12/2001 Jackson
2002/0005874 A1 1/2002 Imai et al.

* cited by examiner

*Primary Examiner*—K. Feggins

(57) ABSTRACT

Methods and systems for managing bubbles in a micro electro mechanical systems device are described. One exemplary system includes a fluid-feed channel configured to supply fluid to a plurality of ejection chambers, individual ejection chambers comprising a resistor configured to eject fluid from the individual ejection chamber. The system further includes a processor configured to cause an individual resistor to be energized at a first intensity sufficient to eject fluid from a respective ejection chamber, the processor further configured to cause the resistor to be energized at a second lower intensity which heats the resistor but does not cause fluid to be ejected from the respective ejection chamber, and wherein the processor can energize, at the second lower intensity level, individual resistors in a pattern designed to detach a bubble from a surface defining a portion of the fluid-feed channel.

40 Claims, 11 Drawing Sheets

MANAGING BUBBLES IN A FLUID-DELIVERY DEVICE

CROSS REFERENCE TO RELATED APPLICATfONS

This application is related to the following U.S. patent application, which is assigned to the present assignee: "Managing Bubbles In A Fluid-Delivery Device", Ser. No. 10/666,751, filed Sep. 18, 2003, inventors Yildirim et al.

BACKGROUND

Contaminants, such as bubbles, can be present in various fluid-delivery or fluid-ejecting devices. In some fluid-delivery devices contaminants can reduce and/or occlude fluid flow and cause the device to malfunction. Management of the contaminants can enhance the performance and reliability of the fluid-delivery device. For these and other reasons, there is a need for the present invention.

BRIEF DESCRIPTION OF THE DRAWINGS

The same components are used throughout the drawings to reference like features and components wherever possible. The diagrammatic representations shown herein are for illustrative purposes and may not be to scale.

DETAILED DESCRIPTION

The embodiments described below pertain to methods and systems for managing bubbles along a fluid-feed path in a micro electro mechanical systems ("MEMS") device such as a print cartridge or other fluid delivery device. Several of the described embodiments are provided in the context of bubble management along a fluid-feed path of a print cartridge for use in a printing device. As such, the term "ink" will be used in the following description, but other fluids are utilized in suitable embodiments.

Print cartridges commonly comprise a cartridge body connected to a print head. Ink can be supplied from and/or through the cartridge body along a fluid-feed path to fluid-ejecting elements contained in and/or proximate to ejection chambers within the print head.

In some embodiments, the fluid-feed path can comprise one or more fluid-feed channels ("channels"), examples of which will be described in the context of fluid-feed slots ("slots") and fluid-feed passageways ("passageways"). In one embodiment, ink flows through a slot formed in a substrate into one or more passageways. An individual passageway can supply an individual ejection chamber which contains a fluid ejecting element that can be energized sufficiently to eject ink from the ejection chamber via an ejection nozzle ("nozzle").

Bubbles can be formed, among other origins, in the ink as a byproduct of operation of a printing device. For example, bubbles can be formed as a byproduct of the ejection process in the print printing device's print cartridge.

If bubbles accumulate along the fluid-feed path such as in the slot or passageway(s), they can occlude ink flow to some or all of the ejection chambers and cause the print head to malfunction. Some embodiments can move bubbles in a desired direction to decrease the likelihood of such a malfunction. In one such example, bubbles are moved to a structure designed to handle bubbles.

Bubbles can be moved, among other ways, by the creation of a thermal gradient in the ink containing the bubbles that causes thermocapillary movement of these bubbles. In some embodiments bubbles are managed by selectively energizing resistors at an intensity sufficient to create a desired thermal gradient in the ink without vaporizing ink and thus without ejecting ink from the print head.

In some embodiments, the resistors can be energized in a bubble moving pattern designed to move a bubble in desired direction. Such movement of a bubble in a desired direction, for example, can move the bubble to a region where it is more likely to migrate out of the fluid-feed path and/or position the bubble in a location that reduces the likelihood of the bubble causing ink occlusion to some or all of the ejection chambers.

Figure 1:
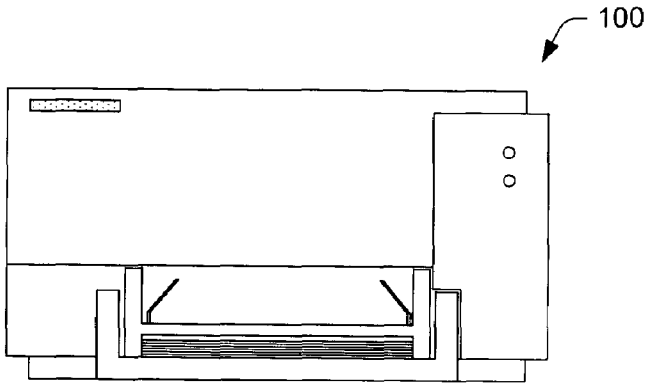
FIG. 1 shows a front elevational view of an exemplary printer in accordance with one embodiment.

FIG. 1 shows an exemplary printing device that can utilize bubble management as described below. In this embodiment, the printing device comprises a printer 100. The printer shown here is embodied in the form of an inkjet printer. The printer 100 can be capable of printing in black-and-white and/or in black-and-white as well as color. The term "printing device" refers to any type of printing device and/or image forming device that employs a fluid-delivery device(s) such as a print cartridge to achieve at least a portion of its functionality. Examples of such printing devices can include, but are not limited to, printers, facsimile machines, photocopiers, and the like. Examples of other fluid delivery devices can include various MEMS devices such as Lab-On-A-Chip which are utilized in various medical and laboratory applications among others.

Figure 1A:
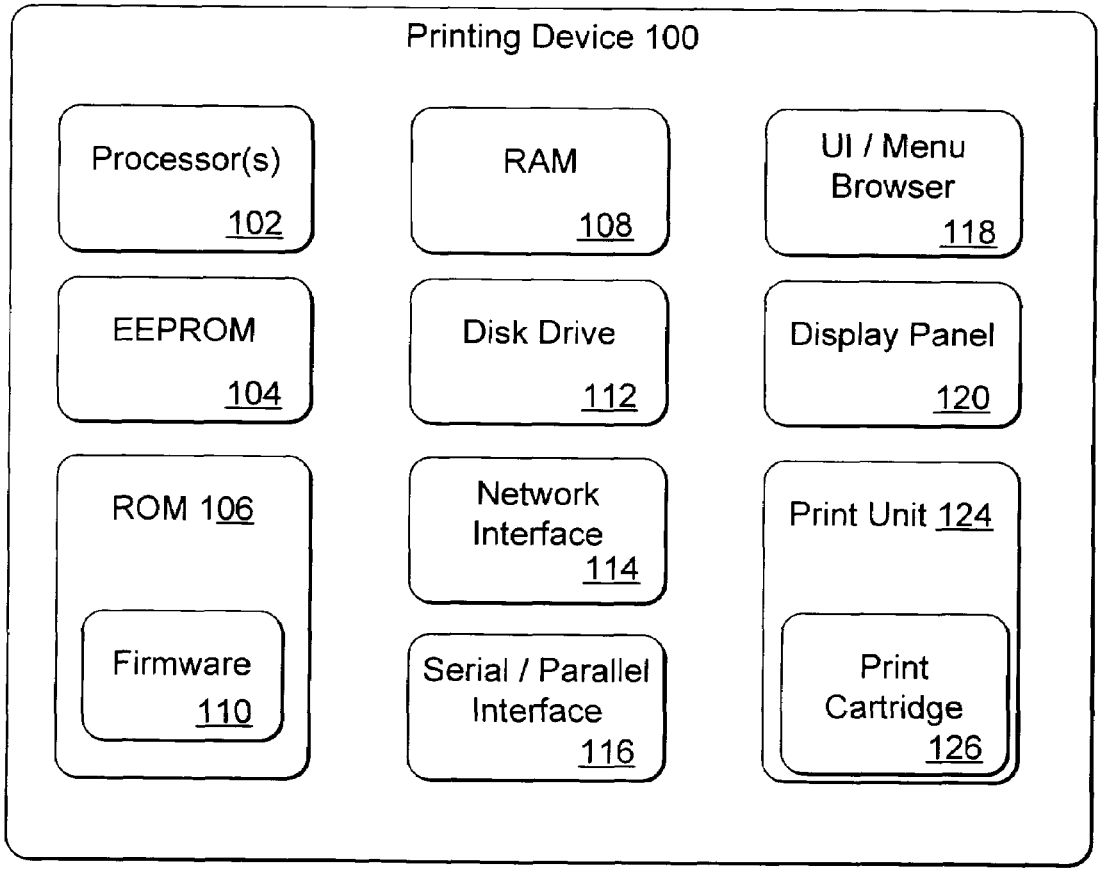
FIG. 1*a* shows a block diagram illustrating exemplary components of one exemplary printer.

FIG. 1*a* illustrates various components of the exemplary printing device 100. Printing device 100 may include one or more controllers that are embodied as one or more processors 102 to control various printing operations, such as media handling, servicing, and ink ejection.

Printing device 100 may have an electrically erasable programmable read-only memory (EEPROM) 104, ROM 106 (non-erasable), and a random access memory (RAM) 108. Although printing device 100 is illustrated as having an EEPROM 104 and ROM 106, a particular printing device may only include one of the memory components. Additionally, although not shown, a system bus may connect the various components within the printing device 100.

The printing device 100 may also have a firmware component 110 that is implemented as a permanent memory module stored on ROM 106. The firmware 110 is programmed and tested in a similar manner as for software, and is distributed with the printing device 100. The firmware 110 may be implemented to coordinate operations of the hardware within printing device 100 and contains programming constructs used to implement such operations.

Processor(s) 102 process various instructions to control the operation of the printing device 100 and to communicate with other electronic and computing devices. The memory components, EEPROM 104, ROM 106, and RAM 108, store various information and/or data such as configuration information, fonts, templates, data being printed, and menu structure information. Although not shown, a particular printing device may also include a flash memory device in place of or in addition to EEPROM 104 and ROM 106.

Printing device 100 also may include a disk drive 112, a network interface 114, and a serial/parallel interface 116, which can comprise any type of suitable interface. Examples of serial/parallel interface 116 can comprise a USB, and/or an IEEE 1394 compliant interface, among others. Disk drive 112 provides additional storage for data being printed or other information maintained by the printing device 100. Although printing device 100 is illustrated as having both RAM 108 and a disk drive 112, a particular printing device may include either RAM 108 or disk drive 112, depending on the storage needs of the printer. For example, some printing devices may include a small amount of RAM 108 and no disk drive 112, thereby reducing the manufacturing cost of the printing device.

Network interface 114 provides a connection between printing device 100 and a data communication network. The network interface 114 allows devices coupled to a common data communication network to send print jobs, menu data, and other information to printing device 100 via the network. Similarly, serial/parallel interface 116 provides a data communication path directly between printing device 100 and another electronic or computing device. Although printing device 100 is illustrated having a network interface 114 and serial/parallel interface 116, a particular printing device may include only one such interface component.

Printing device 100 also may include a user interface and menu browser 118, and a display panel 120. The user interface and menu browser 118 allows a user of the printing device 100 to navigate the printing device's menu structure. User interface 118 may be implemented as indicators or as a series of buttons, switches, or other selectable controls that are manipulated by a user of the printing device. Display panel 120 may be a graphical or textual display that provides information regarding the status of the printing device 100 and the current options available to a user through the menu structure.

Printing device 100 also includes a print unit 124 that includes mechanisms arranged to selectively apply ink (e.g., liquid ink) to a print media such as paper, plastic, fabric, or other suitable material in accordance with print data corresponding to a print job. Such mechanisms can comprise one or more print cartridge(s) 126. The print unit also can include various suitable means for moving the print cartridge(s) 126 and/or print media relative to one another. The function of print unit 124 can be controlled by a controller such as processor 102, which can execute instructions stored for such purposes. Commonly, processor 102 is electrically coupled to, but distinct from, print cartridge 126. However, other suitable embodiments can employ a processor or other suitable controller as a component of an exemplary print cartridge or other MEMS device.

Figure 2:
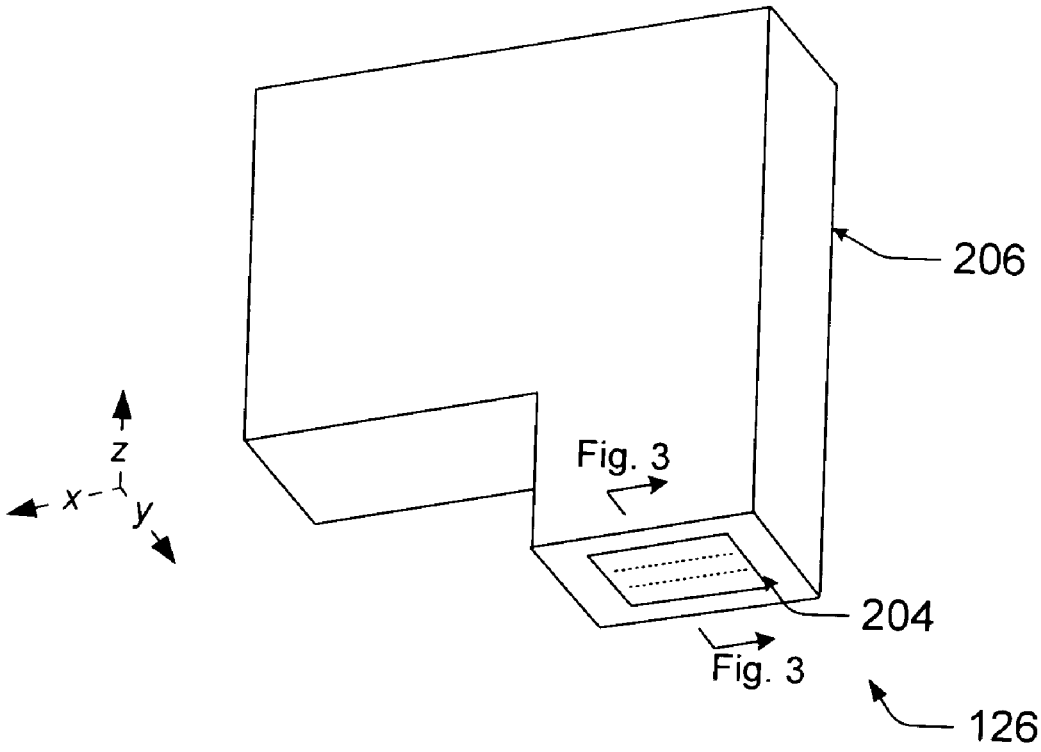
FIG. 2 shows a perspective view of an exemplary print cartridge in accordance with one embodiment.

FIG. 2 shows an exemplary print cartridge 126 that can be used in an exemplary printing device such as printer 100. Print cartridge 126 is comprised of print head 204 extending along a long axis x, and cartridge body 206. While a single print head is shown on print cartridge 126, other print cartridges may have multiple print heads on a single print cartridge. Some suitable print cartridges can be disposable, while others can have a useful lifespan equal to or exceeding that of the printing device. Other exemplary configurations will be recognized by those of skill in the art.

Figure 3:
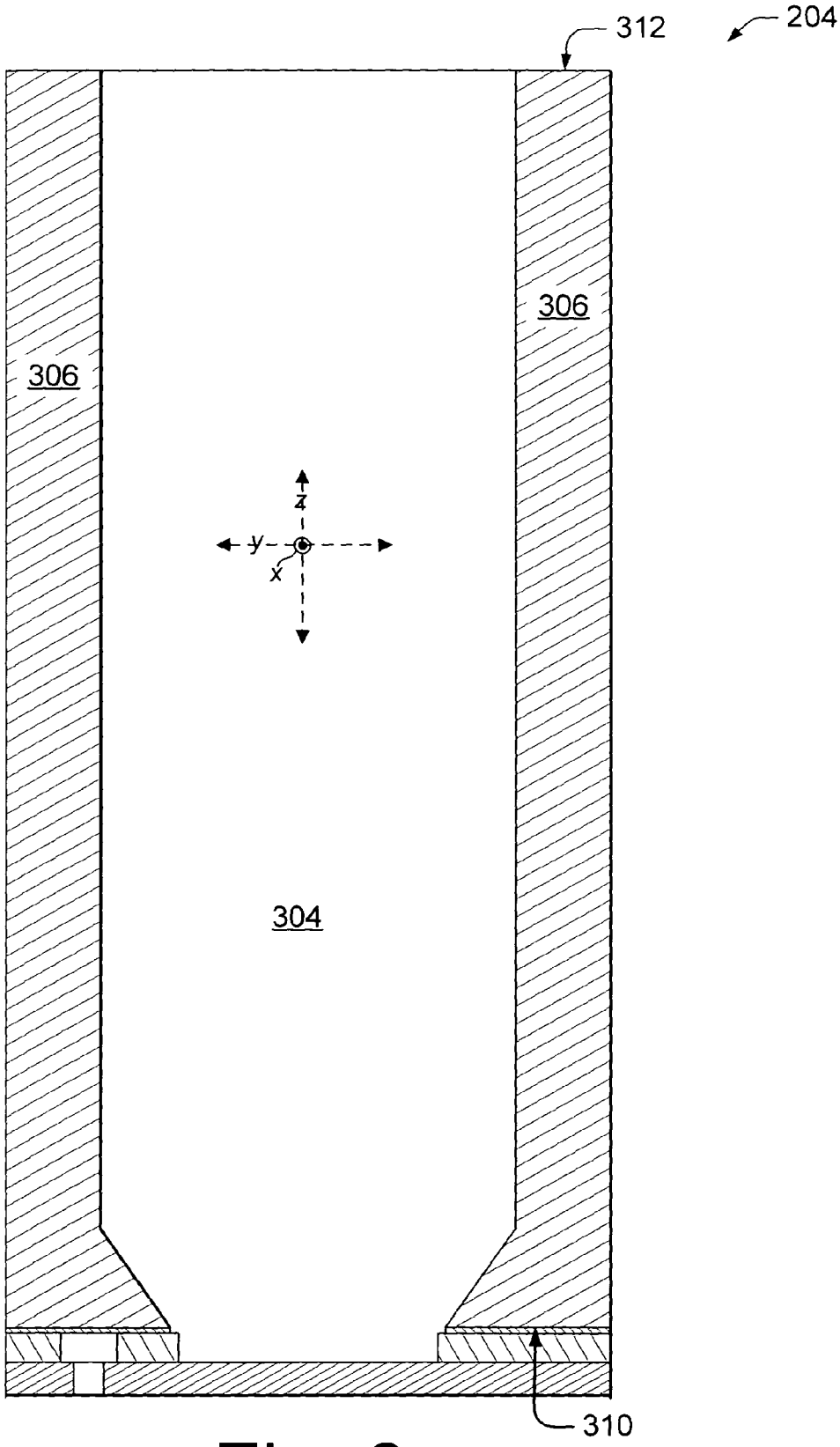
FIG. 3 shows a cross-sectional view of a portion of an exemplary print head as shown in FIG. 2 in accordance with one embodiment.

FIG. 3 shows a cross-sectional representation of print head 204 as shown in FIG. 2. This cross-sectional view is taken along the y-axis which corresponds to a short axis of print head 204. A slot or slots 304 passes through a substrate 306 from a first substrate surface 310 to a generally opposite second substrate surface 312. Slot 304 can have any suitable dimensions. For example, the slot can have any suitable length as measured parallel to the x-axis, with some embodiments having slots in the range of 20,000 microns. Similarly, any suitable slot width taken parallel to the y-axis can be utilized, with many embodiments utilizing slot widths in the 100–200 micron range. Both narrower and wider widths are also suitable.

Substrate 306 can be comprised of silicon, gallium arsenide, glass, silica, ceramics, or a semi-conducting material among other materials. Substrate 306 can comprise various configurations as will be recognized by one of skill in the art. At present 675 micron thick substrates are often utilized, but thinner and/or thicker substrate can also be utilized. For example, if the current trend toward miniaturization continues, future embodiments may commonly utilize substrates having a thickness of 100–300 microns or smaller.

Figure 4:
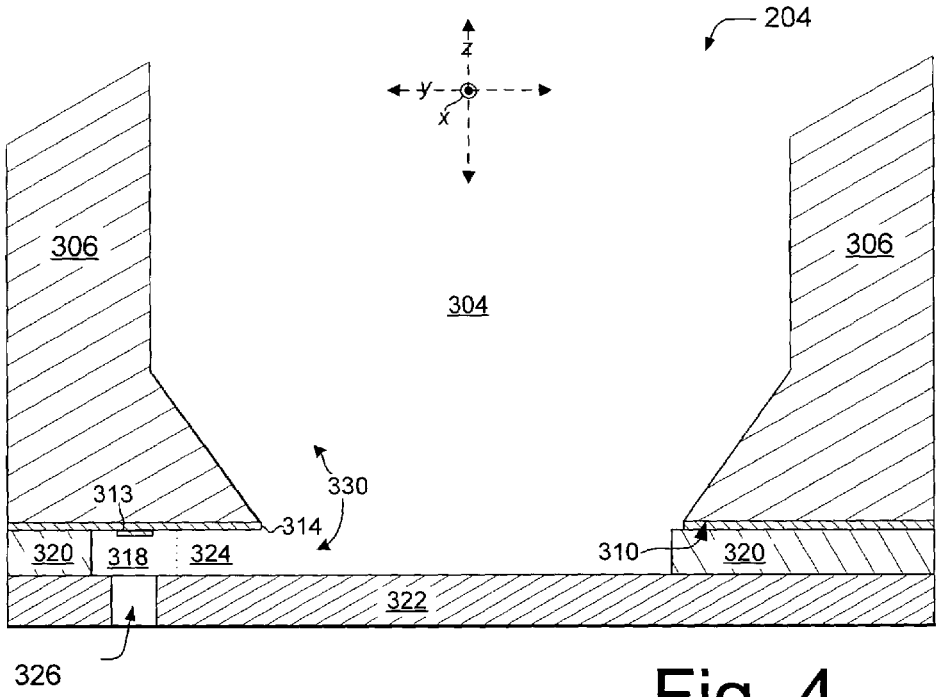
FIG. 4 shows an enlarged cross-sectional view of a portion of the exemplary print head shown in FIG. 3 in accordance with one embodiment.
Figure 5:
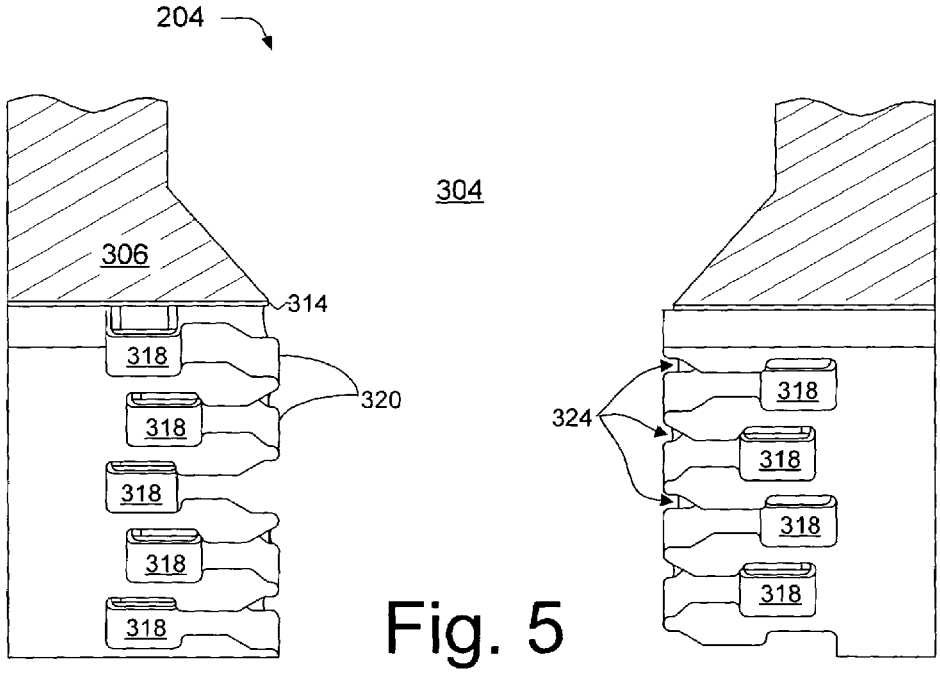
FIG. 5 shows a front elevational view of a portion of the exemplary print head shown in FIG. 3 in accordance with one embodiment.

FIGS. 4–5 show a portion of print head 204 in more detail. FIG. 4 shows a cross-sectional view similar to FIG. 3, while FIG. 5 shows a front elevational view of a cross-sectioned portion of the print head. Various electrical components, such as resistor 313 and electrical traces (not shown) can be formed over first surface 310. Individual resistors 313 are electrically connected to individual electrical traces through which electrical energy can be selectively provided to the respective resistor. Resistors 313 and traces can comprise a portion of a stack of thin film layers 314 positioned over first surface 310.

Individual resistors 313 can be positioned within or proximate to an individual ejection chamber 318. In some embodiments, ejection chamber(s) 318 can be defined, at least in part, by a barrier layer 320 and an orifice plate 322. Other configurations are also possible. The orifice plate has been removed in FIG. 5 to allow underlying components to be better visualized. Ink can be supplied along a portion of channel 330 from slot 304 to ejection chamber 318 via a passageway 324. In this embodiment, passageway 324 is patterned into barrier layer 320. Orifice plate 322 has nozzles 326 formed therein and corresponding to individual ejection chambers 318. As will be recognized by the skilled artisan, this is but one suitable configuration.

Barrier layer 320 can comprise, among other things, a patternable material such as a photo-imagable polymer substrate. In one embodiment orifice plate 322 comprises a nickel substrate. In another embodiment orifice plate 322 is the same material as the barrier layer. The various layers can be formed, deposited, or attached upon the preceding layers. The configuration given here is but one possible configuration. For example, in an alternative embodiment, orifice plate 322 and barrier layer 320 are integral.

When print cartridge 126 is positioned for use, ink can flow from the cartridge body 206 (shown FIG. 2) into slot 304 of print head 204. From slot 304 ink can travel through passageway 324 that leads to ejection chamber 318. Ink can be selectively ejected from ejection chamber 318 by energizing a respective resistor 313 at a first intensity selected to sufficiently vaporize some of the ink adjacent to the resistor surface and contained in the ejection chamber. Such vaporization can increases pressure within ejection chamber 318 sufficient to expel a desired amount of the ink.

Print head 204 is configured to replace the ink expelled from ejection chamber 318 via an individual passageway 324 supplying the ejection chamber. However, one or more bubbles can occlude or obstruct the passageway 324 and prevent or slow the replacement of the ejected ink. Such bubbles can be carried into position by the ink, can be caused by 'out-gassing' from the ink and/or can be generated during vaporization of the ink, among other origins.

Figure 6:
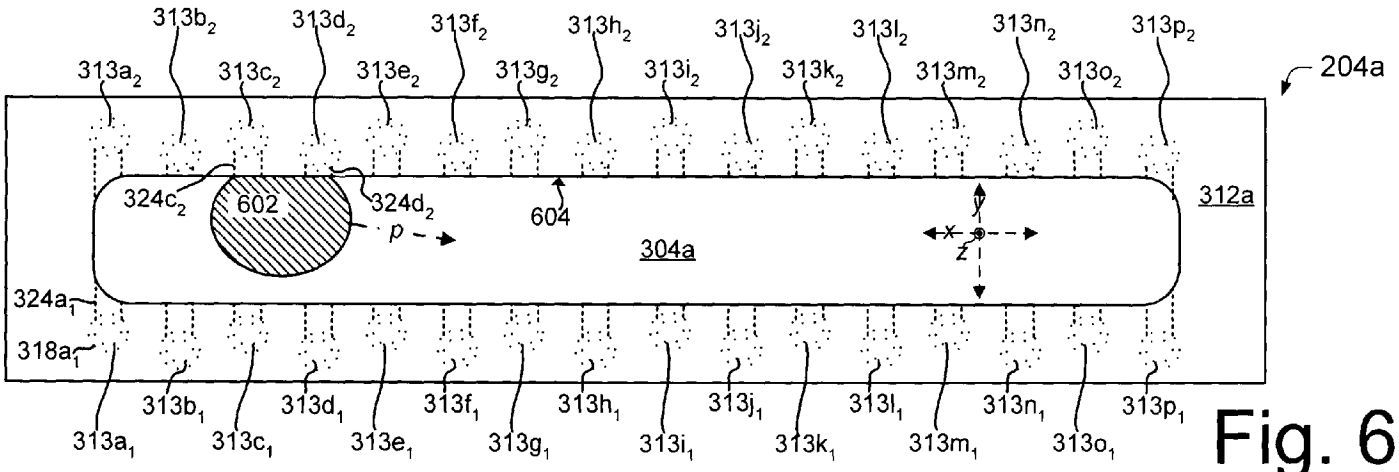
FIG. 6 shows a top view of an exemplary print head in accordance with one embodiment.
Figure 7:
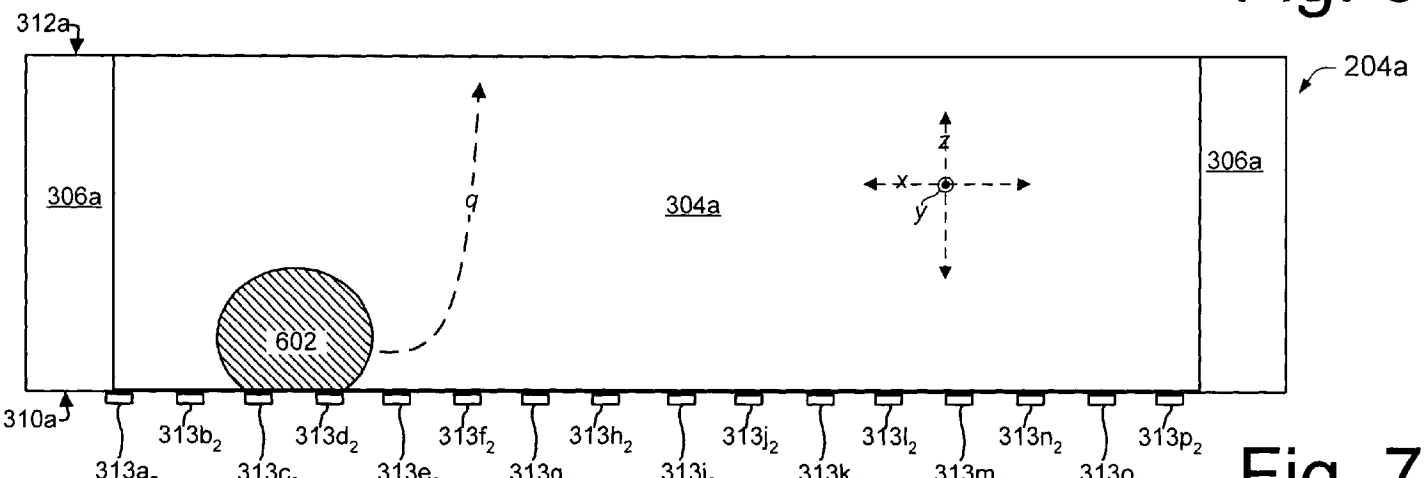
FIG. 7 shows a cross-sectional view taken along a long axis through the exemplary print head shown in FIG. 6 in accordance with one embodiment.

FIGS. 6–7 show views along a long axis of another exemplary print head 204*a*. FIG. 6 shows a view from above a second surface 312*a* of substrate 306*a*, while FIG. 7 shows a view through a long axis of slot 304*a* that is parallel to the x-axis, and is generally orthogonal to first surface 310*a* and second surface 312*a*.

Resistors 313$a_1$–313$p_2$ are shown with respective passageways and ejection chambers. To enhance clarity on FIGS. 6–7, not all of the passageways and ejection chambers are labeled, but an example is indicated in relation to resistor 313$a_1$ located in respective ejection chamber 318$a_1$ which is in fluid flowing relation to passageway 324$a_1$. FIG. 6 shows the resistors, ejection chamber, and passageways in dashed lines to indicate that they may be obscured in this view by portions of substrate 306*a*. In this embodiment each of the individual ejection chambers is equipped with a resistor. In some embodiments some of the ejection chambers, sometimes referred to as "dummy chamber(s)", are not equipped with a resistor or are not intended to be used to eject ink, but instead provide other functions. For example, dummy chambers may be incorporated at the slot end of some embodiments to provide more equal operating conditions to each of the functional ejection chambers.

FIGS. 6–7 further show a bubble 602 occupying a portion of slot 304*a*. As shown here, bubble 602 is positioned against sidewall or surface 604 and is occluding and/or reducing ink flow to the passageways 324$c_2$, 324$d_2$. Though a single bubble 602 is illustrated here, the description is equally applicable to multiple bubbles.

The description above provides an example of how individual resistors can be energized at a first intensity selected to sufficiently vaporize and eject ink. In this embodiment, individual resistors 313$a_1$–313$p_2$ can be energized at a second lower intensity in a bubble moving pattern designed to move bubble 602 within slot 304*a*. The second intensity can be primarily selected to heat but not to vaporize the ink. In some embodiments, the second intensity does not cause any ink to be ejected from the respective ejection chamber. Other embodiments may cause incidental ejection of ink.

In some embodiments such a bubble moving pattern sequentially energizes groups of resistors to detach a bubble from a wall defining a fluid-feed channel. In this embodiment the bubble moving pattern comprises sequentially energizing groups of resistors to detach the bubble 602 from sidewall 604 and to move it in a desired direction indicated by arrow p toward the center of slot 304*a*. From this location, due to buoyancy forces among others, bubble 602 may more easily float upward and out of slot 304*a* as indicated generally by arrow q.

In this particular embodiment resistors 313$c_1$ and 313$d_2$ are energized followed by 313$d_1$ and 313$e_2$, and then 313$e_1$ and 313$f_2$. In an alternative embodiment resistors 313$d_2$, 313$e_2$, and 313$f_2$ can be energized sequentially energized to move bubble 602. This energizing moves the bubble along with other factors by creating and/or moving a thermal gradient through the ink contained in slot 304*a*, which in turn can give rise to a thermocapillary migration. In this embodiment the thermal gradient moves the bubble generally along a path indicated by arrow p. Alternatively or additionally, such energizing may create buoyancy driven convective currents and/or surface tension variation induced bubble oscillations which may dislodge and/or move the bubble.

Other suitable embodiments may utilize a pattern designed to move a bubble within the slot to an area designed to handle bubbles. Examples of such areas include areas and/or structures designed to promote the bubble to migrate out of the slot. In one such example bubbles are moved to a location within the slot where the bubble can be evacuated from the slot.

Figure 8:
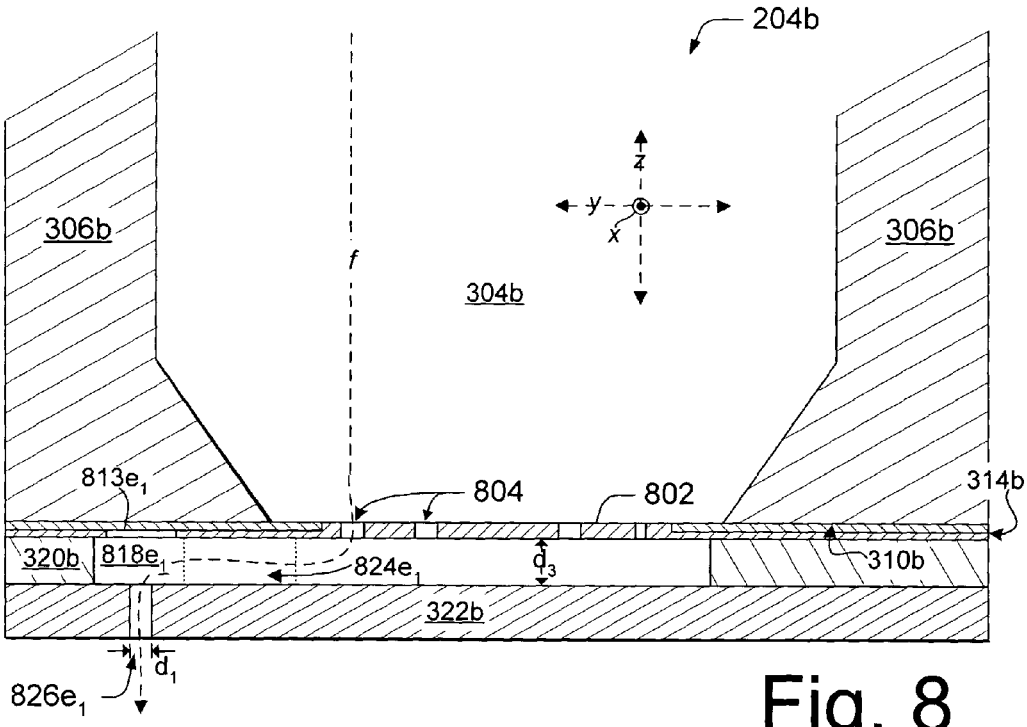
FIG. 8 shows an enlarged cross-sectional view of a portion of an exemplary print head in accordance with one embodiment.
Figure 9:
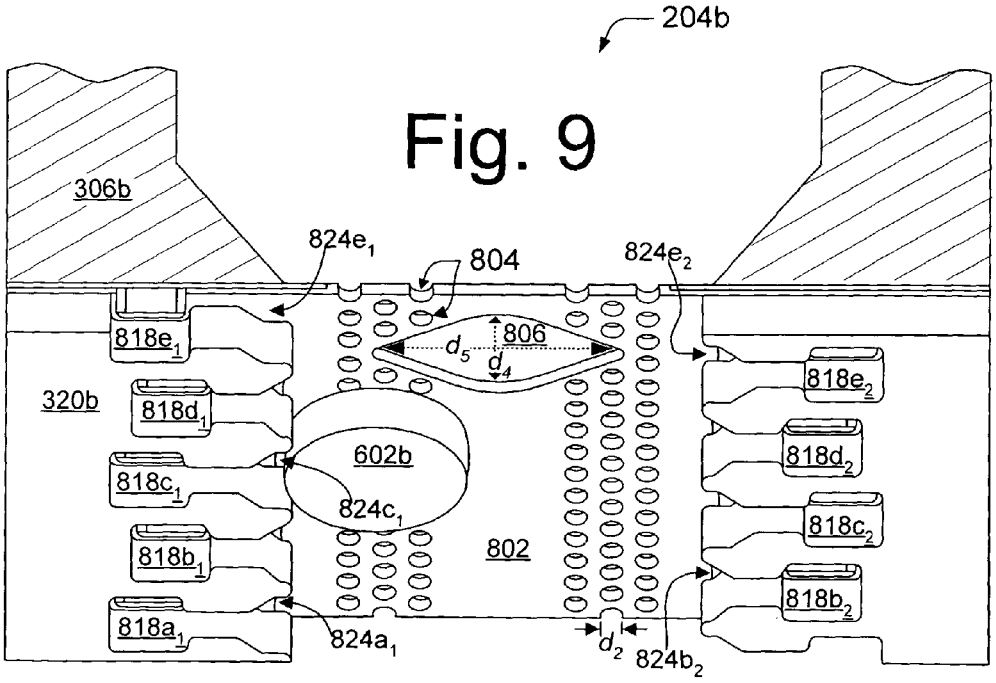
FIG. 9 shows a front elevational view of a portion of the exemplary print head shown in FIG. 8 in accordance with one embodiment.

FIGS. 8–9 show another exemplary print head 204*b*. FIG. 8 shows a cross-section taken transverse to the print head's long axis x which extends into and out of the page on which FIGS. 8–9 appear. FIG. 9 shows a front elevational view of a cross-section taken through print head 204*b*. As shown in FIG. 9, orifice plate 322*b* has been removed to allow underlying components to be more easily observed.

In the embodiment shown in FIGS. 8–9, a filter 802 is positioned across an ink flow path f of print head 204*b*. The print head comprises substrate 306*b* that has slot 304*b* formed therethrough between first and second surfaces 310*b*, 312*b*. In this particular embodiment, filter 802 is positioned between the substrate's first surface 310*b* and various passageways 824$a_1$–824$e_2$ which supply respective ejection chambers 818$a_1$–818$e_2$ so that ink passes through the filter as it travels through print head 204*b*. In this particular embodiment filter 802 has apertures formed therein and defines a border between slot 304*b* and the ink feed passageways 824$a_1$–824$e_2$. In order to promote clarity, not all of passageways 824$a_1$–824$e_2$ are specifically designated, but individual passageways supply correspondingly labeled ejection chambers 818$a_1$–818$e_2$.

In this embodiment filter 802 comprises a generally planer photo-imagable polymer filter layer positioned over the substrate's first surface 310*b*. The photo imagable polymer layer has apertures formed therein through which ink can flow. In this particular embodiment, the photo imagable filter layer is spun-on over the thin-film layers 314*b* prior to completion of slot 304*b*. The photo imagable filter layer is patterned and etched to form the apertures. Further, in this embodiment, barrier layer 320*b* is positioned over the photo imagable filter layer before etching. In some embodiments, the filter comprises a portion of a manifold formed from the thin-film layers 314*b* and/or barrier layer 320*b*. The skilled artisan will recognize other suitable configurations. For example, other filters may comprise different materials and/or may utilize other aperture shapes and/or sizes. In one such example, a stainless steel filter may be utilized with generally square apertures.

In this embodiment, the apertures comprise a first size aperture ("first aperture") 804 and a second larger size aperture ("second aperture") 806. Also, in this embodiment, first aperture(s) 804 have a cross-sectional area chosen in relation to various components of print head 204*b*. For example, in this embodiment, orifice plate 322*b* has multiple nozzles corresponding to respective ejection chambers. One such nozzle is designated 826. Individual nozzles can have a cross-sectional bore diameter $d_1$ of about 15 microns. Accordingly, the first aperture(s) 804 can have a cross-sectional dimension $d_2$ slightly smaller than the nozzle's bore diameter $d_1$ to exclude contaminants that might lodge in or otherwise block a nozzle.

In this embodiment, the first aperture(s) 804 can have a cross-sectional dimension of about 14 microns or less. In this particular embodiment, the first aperture(s) 804 are generally circular so that the cross-sectional dimension $d_2$ is the diameter.

When print head 204*b* is utilized for printing, a bubble or bubbles may form and/or get lodged between orifice plate 322*b* and filter 802. As shown here, a bubble 602*b* is proximate to, and occluding, ejection chamber 818$c_1$, via passageway 824$c_1$. One or more of the resistors, such as 813$e_1$ can be utilized to move bubble 602*b* and to restore ink flow. In this embodiment bubble 602*b* can be moved toward second aperture 806 to allow the bubble to exit into slot 304*b*.

Second aperture 806 can have a shape and location determined based on several criteria, including but not limited to, a distance $d_3$ extending normally between filter 802 and orifice plate 322*b*. In this embodiment second aperture 806 has a minimum dimension $d_4$ which is larger than the filter 802 to orifice plate 322*b* dimension $d_3$. In this embodiment a diamond shape second aperture 806 is utilized where the minimum dimension $d_4$ comprises the width, and the length comprises dimension $d_5$.

In this particular embodiment second aperture 806 is about 20–30 microns wide and 50–60 microns long. Such a configuration of the second aperture dimensions relative to the filter 802 to orifice plate 322*b* dimension can facilitate passage of bubble 602*b* into slot 304*b*. Stated another way, bubbles may tend to migrate through the second aperture if the dimensions of the second aperture are larger than the filter to orifice plate dimension. This is but one suitable example, and other suitable apertures may have smaller or larger dimensions. Though a diamond shaped second aperture 806 is shown here, other suitable embodiments can utilize other geometric shapes including but not limited to rectangles, circles and/or irregularly shapes. Further, though only a single second aperture 806 is utilized in this embodiment, other suitable embodiments may utilize more than one of the second apertures.

Figure 10:
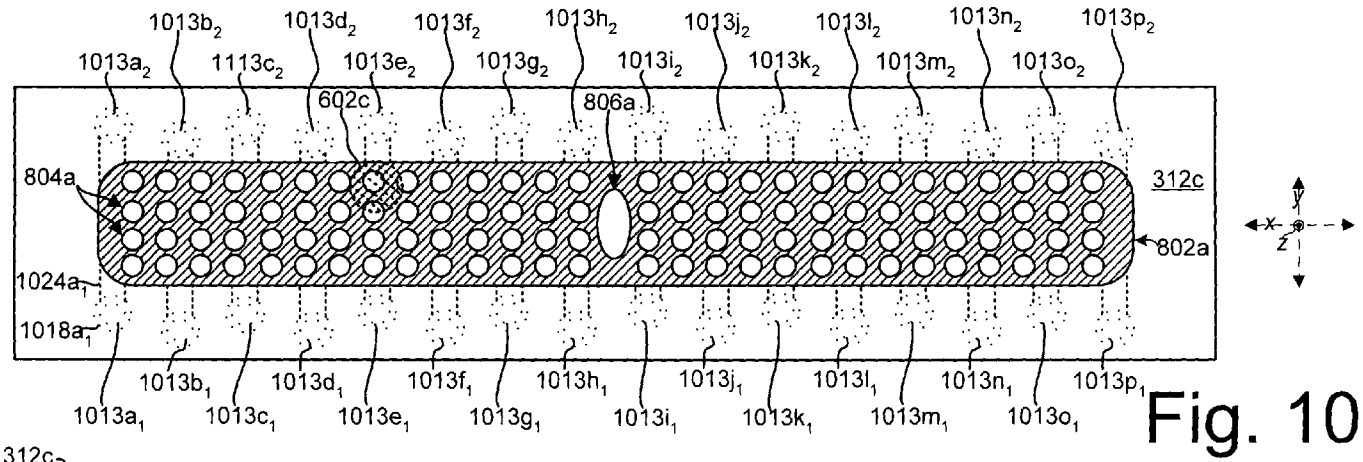
FIG. 10 shows a top view of an exemplary print head in accordance with one embodiment.
Figure 11:
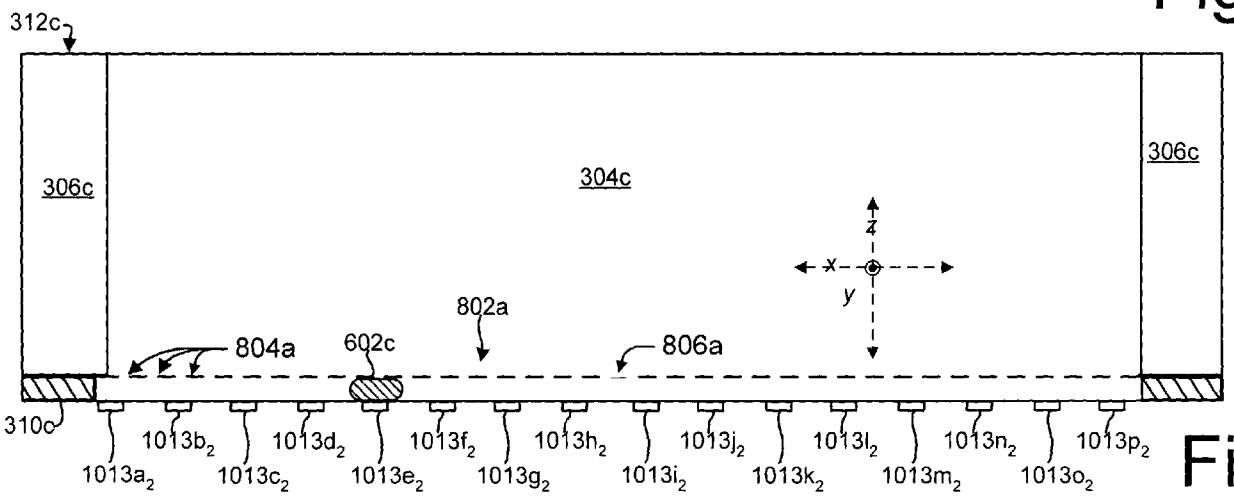
FIG. 11 shows a cross-sectional view taken along a long axis through the exemplary print head shown in FIG. 10 in accordance with one embodiment.

FIGS. 10–11 show another embodiment similar to the one shown in FIGS. 8–9. FIGS. 10–11 show views taken along a long axis of a slot 304*c* where the long axis is generally parallel to the x-axis. FIG. 10 is taken from above second surface 312*c*, while FIG. 11 is orthogonal to the second surface 312*c*.

A filter 802*a* is positioned below first surface 310*c* of substrate 306*c*. Filter 802*a* has first apertures 804*a* and a second aperture 806*a* positioned generally below slot 304*c*. Multiple resistors 1013$a_1$–1013$p_2$ are shown with respective ejection chambers and passageways. To enhance clarity on FIGS. 10–11, not all of the passageways and ejection chambers are labeled, but an example is indicated in relation to resistor 1013$a_1$ located in respective ejection chamber 1018$a_1$ which is in fluid flowing relation to passageway 1024$a_1$. For purposes of illustration, FIG. 11 shows resistors 1013$a_2$–1013$p_2$ positioned below the filter, although in practice they may be much closer to lying in a plane containing filter 802*a*.

A bubble 602*c* can be seen beneath filter 802*a* and proximate to resistor 1013$e_2$ and associated ejection chamber. Individual resistors can be energized in a bubble moving pattern designed to move bubble 602*c* toward second aperture 806*a*.

Various suitable patterns can be utilized to achieve the bubble moving pattern. For example, one suitable pattern comprises sequentially energizing pairs of resistors to create and/or move one or more thermal gradients through the fluid to move any bubbles toward second aperture 806*a*. In one such example, resistor pair 1013$f_1$–1013$f_2$ is energized followed by 1013$g_1$–1013$g_2$, and then 1013$h_1$–1013$h_2$. This sequence can be followed by resistor pairs 1013$g_1$–1013$g_2$ followed by 1013$h_1$–1013$h_2$, and then 1013$i_1$–1013$i_2$, etc. to progressively move bubble 602*c* toward the second aperture 806*a*.

Figure 12:
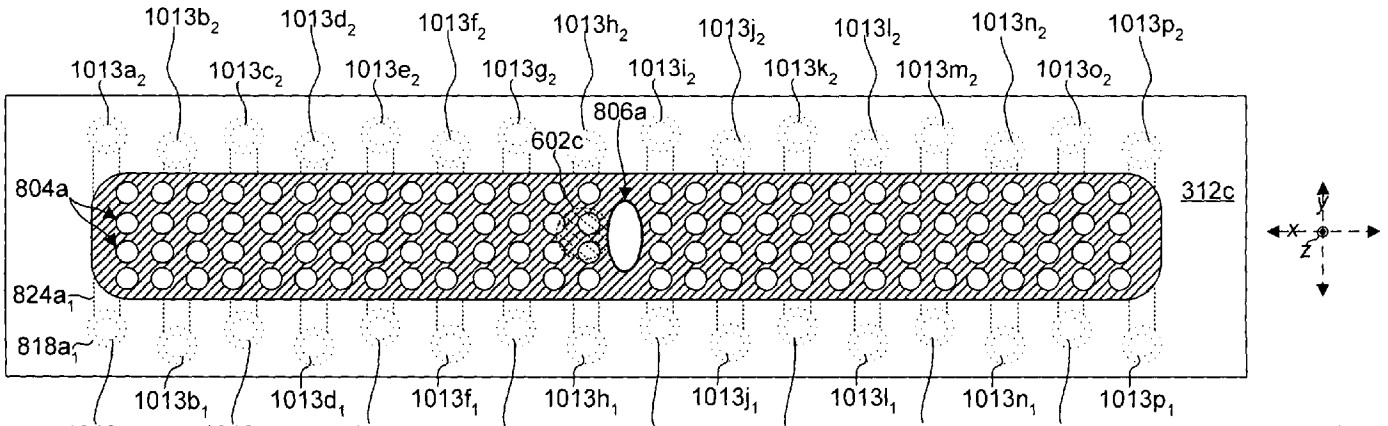
FIG. 12 shows a top view of an exemplary print head in accordance with one embodiment.
Figure 13:
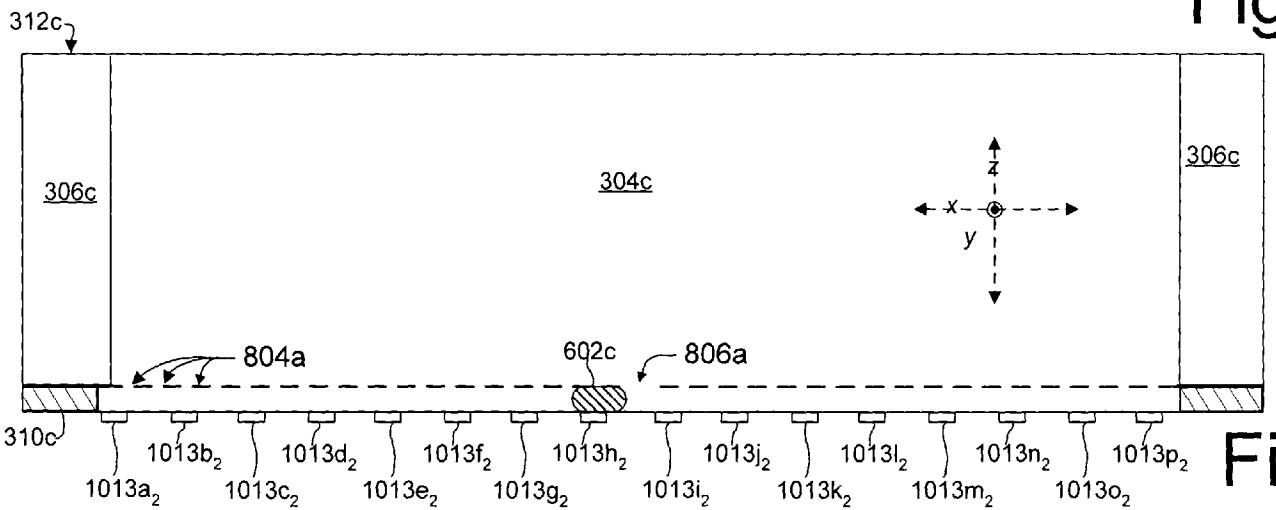
FIG. 13 shows a cross-sectional view taken along a long axis through the exemplary print head shown in FIG. 11 in accordance with one embodiment.
Figure 12A:
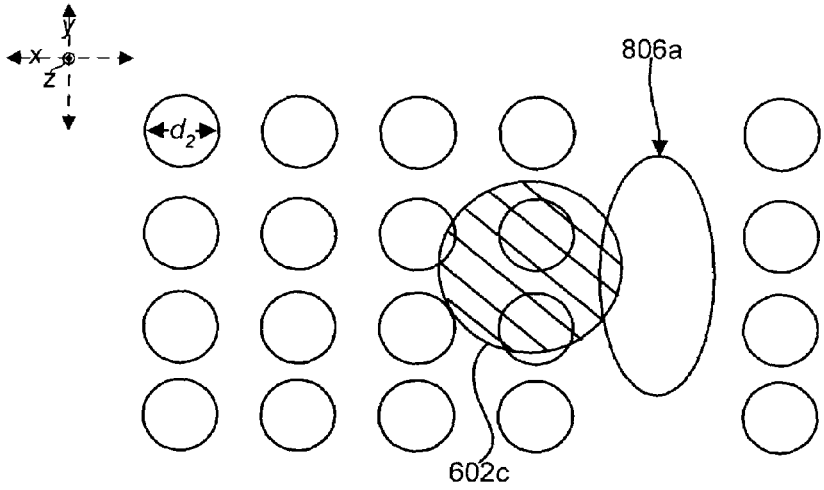
FIG. 12*a* and FIG. 12*b* show an enlarged top view of a portion of the exemplary print head shown in FIG. 12 in accordance with one embodiment.
Figure 13A:
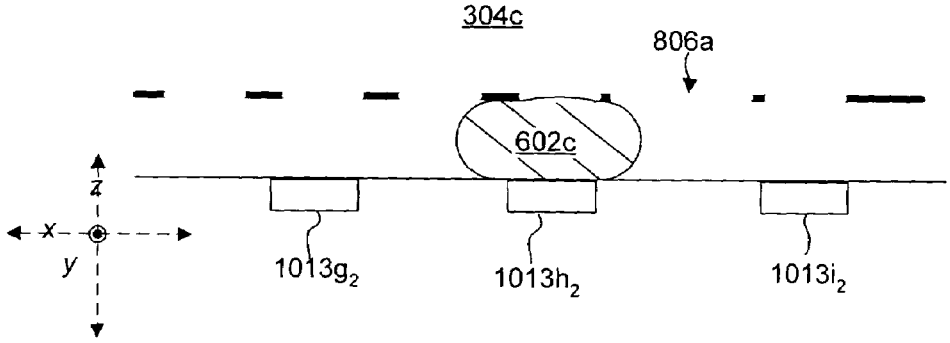
FIG. 13*a* and FIG. 13*b* show an enlarged cross-sectional view of a portion of the exemplary print head shown in FIG. 13 in accordance with one embodiment.
Figure 12B:
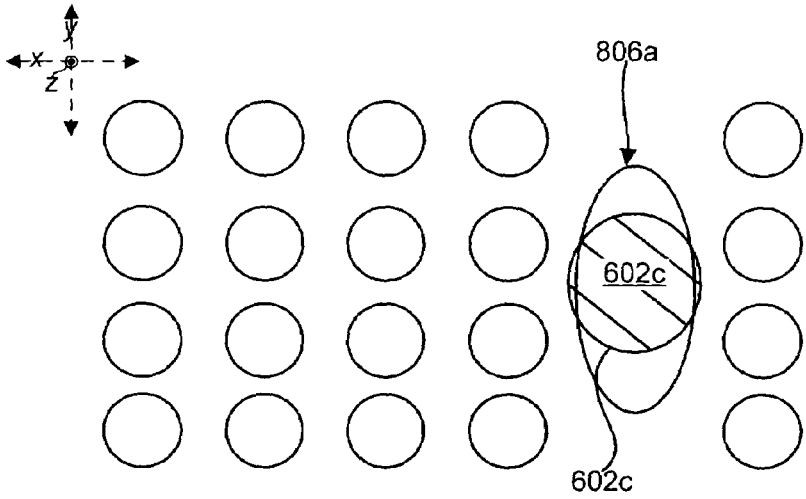
Figure 13B:
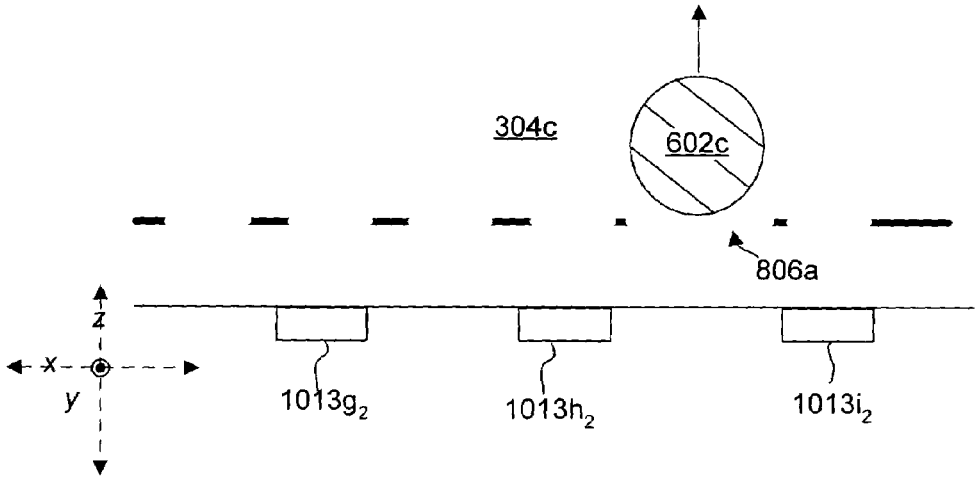

FIGS. 12–13 show views similar to those shown in FIGS. 10–11 respectively, with the exception that bubble 602*c* is now positioned more proximate to second aperture 806*a*.

FIGS. 12*a*–13*a* show enlarged views of a region surrounding bubble 602*c* as shown in FIGS. 12–13 respectively. Once bubble 602*c* is proximate to second aperture 806*a* it can migrate through aperture 806*a* up into slot 304*c* as shown in FIGS. 12*b*–13*b*. Though this example only describes sequentially energizing resistors from one end of the slot toward the middle, many other suitable bubble moving patterns can be utilized. For example, a similar pattern may be utilized simultaneously at the other end of the slot to simultaneously move bubbles from both ends toward second aperture 806*a*.

As shown in this embodiment, second aperture 806*a* is generally centrally located within slot 304*c* so that bubbles on the right side can be moved toward the center and similarly bubbles on the left can be moved toward the center. Bubbles then may pass through second aperture 806*a* of the filter 802*a* and migrate out of slot 304*c*. The bubbles then can migrate upward and out of the slot unaided and/or further energizing can be utilized to facilitate desired movement of the bubbles. A similar suitable embodiment can locate second aperture 806*a* near one end of the slot and move bubbles toward that end.

Figure 14:
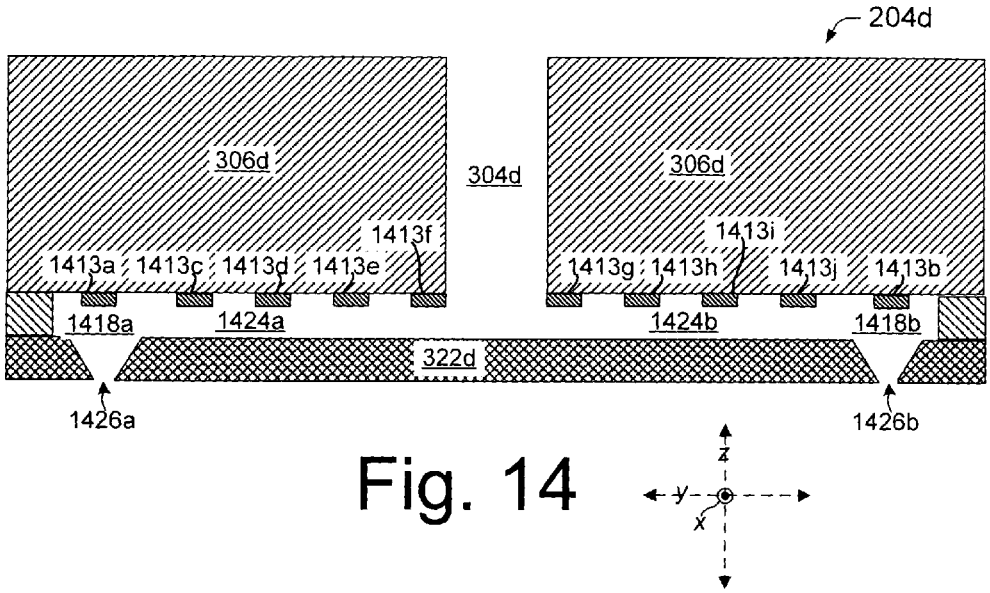
FIG. 14 shows a cross-sectional view of an exemplary print head in accordance with one embodiment.
Figure 15:
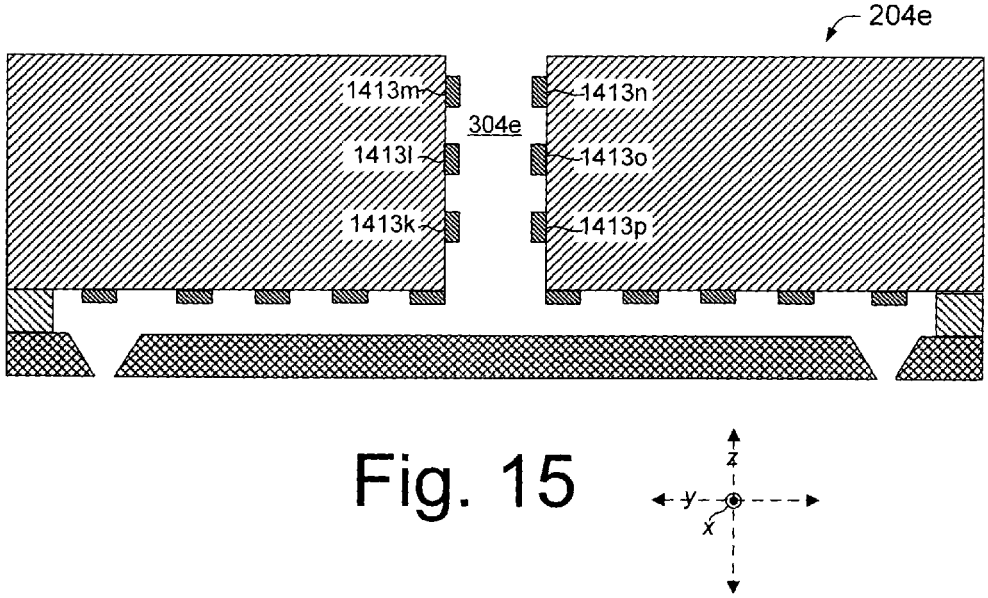
FIG. 15 shows a cross-sectional view of an exemplary print head in accordance with one embodiment.

FIGS. 14–15 show cross-sectional views of two additional exemplary print heads 204*d*, 204*e*. Each view is taken along a short axis of a slot 304*d*, 304*e* respectively and generally parallel to the y axis.

FIG. 14 shows a slot 304*d* formed through a substrate 306*d* and supplying passageway 1424*a*, 1424*b*. The two passageways 1424*a*, 1424*b* are configured to supply ink to respective ejection chambers 1418*a*, 1418*b* respectively. The ejection chambers are configured to eject ink through nozzles 1426*a*, 1426*b* respectively, which are formed in orifice plate 322*d*. Fluid ejection from individual ejection chambers 1418*a*, 1418*b* can be controlled by energizing resistors 1413*a*, 1413*b* respectively.

In addition to resistors 1413*a*, 1413*b*, which are positioned in the ejection chambers, several additional resistors 1413*c*–1413*j* are positioned along the two passageways 1424*a*, 1424*b*.

Resistors 1413*a*, 1413*b* can be formed using known thin-film techniques. Resistors 1413*c*–1413*j* positioned along the passageways can be formed at the same time as resistors 1413*a*, 1413*b* utilizing the same thin film techniques. Alternatively resistors 1413*a*, 1413*b* can be formed at a different time and/or with different techniques. Further, resistors 1413*c*–1413*j* can be identical to resistors 1413*a*, 1413*b* or can have a different configuration.

Bubbles can be managed in print head 204*d* utilizing several suitable embodiments. For example, in one such embodiment, resistors 1413*a*, 1413*b* are utilized to eject fluid from their respective ejection chambers 1418*a*, 1418*b* and resistors 1413*c*–1413*i* can be energized in a bubble moving pattern designed to move a bubble in a desired direction. Another example is configured to energize selectively resistors 1413*a*, 1413*b* at a first intensity selected primarily to cause ink ejection and at a second lower intensity selected primarily to heat ink, but not cause ink ejection. Resistors 1413*a*, 1413*b* can be selectively energized at the second lower intensity level in combination with one or more of resistors 1413*c*–1413*i* in a bubble moving pattern.

FIG. 15 shows another suitable embodiment. In this embodiment additional resistors 1413*k*–1413*p* are positioned along slot 304*e*. The additional resistors 1413*k*–1413*p* can be energized in various bubble moving patterns either alone or in combination with other resistors, such as those described in relation to FIG. 14, to promote bubble movement. Other embodiments, can position resistors at other locations within the print head.

Although the embodiments described above have utilized resistors to move the bubbles, other embodiments may utilize other electrical components of a print head either alone or in combination with one or more resistors. In one such example transistors are incorporated into many print head designs. The location of such transistors relative to the fluid-feed path may allow such transistors to be controlled in a manner which contributes to creation and movement of a thermal gradient within ink contained in the path for the purpose of moving bubbles. Such an example can provide bubble management for print heads which primarily utilize energizing elements other than resistors to achieve fluid ejection. In one such print head which employs piezoelectric crystals to eject fluid, various electrical components including the crystals can be energized primarily to move bubbles in a desired direction and not primarily to eject ink.

Energizing resistors and/or other electrical components in a bubble moving pattern can be achieved in any suitable manner. In one such embodiment a controller or processor such as processor 102 can cause various resistors to be energized to achieve the desired bubble moving pattern. The processor can cause such energizing by, including but not limited to, processing various computer readable instructions which are stored on suitable computer readable media, examples of which are provided above. The computer readable instructions may be contained on the printing device or may be imported via a network connection.

Bubble management can be implemented in various suitable configurations. For example, in one such embodiment, a printing device may be equipped with an ink droplet detector that checks for proper print head function from time to time. If the detector indicates that the print head is not operating within desired parameters such as would be caused from ink starvation of one or more ejection chambers, then the processor may cause resistors to be energized in a bubble moving pattern to move any bubbles which may cause such starvation.

In other embodiments, the processor may cause resistors to be energized in a bubble moving pattern based upon one or more suitable parameters such as passage of a given period of time and/or a number of lines or pages printed. For example, one suitable embodiment may from time to time simply energize various electrical components in a bubble moving pattern as a preventive measure. This particular example can operate without any system for determining the presence and/or location of bubbles in the print head.

Other suitable embodiments may monitor alternatively or additionally other conditions relative to the print head to determine when resistors may be energized to manage bubbles and in what pattern. For example, operating conditions such as temperature can affect bubble formation so that some suitable embodiments may inter-relate the incidence of bubble management with a sensed temperature of the print head or portions thereof. Still other embodiments may be designed from feedback based on lab data which indicates a propensity for bubbles to gather in a particular area of a given print head design. The bubble moving patterns can be selected based on this data to promote bubble movement away from these particular areas.

In a similar embodiment the placement of one or more of the resistors may be based on such feedback to maximize the effectiveness of the bubble management. For example, if it is determined that bubbles tend to gather at a particular region along an ink feed path one or more resistors may be positioned relative to the region to promote bubble movement.

The described embodiments can provide methods and systems for managing bubbles along a fluid-feed path of a MEMS device. The bubbles can be managed by energizing one or more electrical devices such as resistors in a bubble moving pattern designed to move and/or dislodge bubbles in the fluid. Such energizing can exploit various mechanisms to achieve the bubble movement. Energizing the electrical devices in a bubble moving pattern can move the bubbles to a desired location along the fluid-feed path.

Although the inventive concepts have been described in language specific to structural features and methodological steps, it is to be understood that the appended claims are not necessarily limited to the specific features or steps described. Rather, the specific features and steps are disclosed as forms of implementation.

What is claimed is:

1. A printing device comprising:

multiple ejection chambers positioned in a print head, individual ejection chambers comprising an electrical component, the print head defining a fluid-feed path configured to supply fluid to the ejection chambers for ejection from the print head;

a filter extending generally across the fluid-feed path so that fluid passes through the filter before reaching the multiple ejection chambers; and, a controller configured to cause energizing of individual electrical components in a bubble moving pattern designed to move a bubble located between the ejection chambers and the filter to a region where the bubble can pass through the filter, wherein said energizing does not cause fluid to be ejected from the print head.

2. The printing device of claim 1, wherein the electrical component comprises a resistor.

3. The printing device of claim 1, wherein the filter comprises a generally planar surface that extends generally transverse the fluid-feed path.

4. The printing device of claim 1, wherein the filter comprises a portion of a manifold which supplies fluid received from a fluid feed slot to individual ejection chambers.

5. The printing device of claim 1, wherein the filter comprises a photo-imagable polymer layer having apertures patterned therein.

6. The printing device of claim 1, wherein the filter comprises a layer having apertures patterned therein.

7. The printing device of claim 6, wherein the apertures are generally uniform in size.

8. The printing device of claim 6, wherein the layer is positioned between a silicon substrate through which the fluid-feed path passes and the multiple ejection chambers.

9. The printing device of claim 6, wherein individual ejection chambers comprise a nozzle and wherein a nozzle bore dimension taken transverse to the fluid-feed path is greater than a dimension of an individual aperture taken transverse the fluid-feed path.

10. The printing device of claim 6, wherein the apertures are generally uniform in shape.

11. The printing device of claim 6, wherein the apertures comprise multiple apertures of a first size and at least one second larger size aperture.

12. The printing device of claim 11, wherein the at least one second larger size aperture is generally diamond shaped when viewed transverse to the fluid-feed path.

13. The printing device of claim 11, wherein individual apertures comprising the multiple apertures of the first size are generally circular when viewed transverse to the fluid-feed path.

14. The printing device of claim 11, wherein the at least one second larger size aperture is centrally located on the layer.

15. The printing device of claim 1, wherein the multiple ejection chambers are arranged in a generally linear array, and wherein the controller is configured to energize the resistors in a pattern comprising a sequential pattern involving resistors of at least two adjacent ejection chambers.

16. The printing device of claim 1, wherein the resistors are arranged in pairs with the resistors comprising each pair located on opposing sides of a fluid-feed channel, and wherein the controller is configured to sequentially energize pairs of resistors to move the bubble.

17. A fluid ejecting system comprising:

a fluid-feed channel configured to supply fluid to a plurality of ejection chambers, individual ejection chambers comprising a resistor configured to eject fluid from the individual ejection chamber; and, a processor configured to cause an individual resistor to be energized at a first intensity sufficient to eject fluid from a respective ejection chamber, the processor further configured to cause the resistor to be energized at a second lower intensity which heats the resistor but does not cause fluid to be ejected from the respective ejection chamber, and wherein the processor can energize, at the second lower intensity level, individual resistors in a pattern designed to detach a bubble from a surface defining a portion of the fluid-feed channel.

18. The system of claim 17, wherein the fluid-feed channel is defined in a printing device, and wherein the processor comprises a portion of the printing device.

19. The system of claim 17, wherein the fluid-feed channel is defined in a printing device, and wherein the processor comprises a portion of a computing device coupled to the printing device.

20. The system of claim 17, wherein the processor is configured to detach and to move the bubble.

21. The system of claim 20, wherein the processor is configured to move the bubbles in a direction generally opposite to a direction of fluid flow in the fluid-feed channel.

22. The system of claim 20, wherein the processor is configured to move the bubbles toward a structure configured to evacuate bubbles from the fluid-feed channel.

23. The system of claim 20 further comprising a filter positioned to prevent contaminants in the fluid from entering the ejection chambers, and wherein the processor is configured to detach and to move a bubble located between the filter and the ejection chambers.

24. A printing device comprising:

a print head comprising multiple electrical components;

multiple ejection chambers formed in the print head, at least some of the individual ejection chambers comprising an associated one of the multiple electrical components configured to be energized sufficiently to cause fluid to be ejected from the ejection chamber, the print head defining a fluid-feed channel configured to supply fluid to the ejection chambers for ejection from the print head; and, a controller configured to cause energizing and resultant heating of at least some of the multiple electrical components in a bubble moving pattern designed to move a bubble in a desired direction within the fluid-feed channel, wherein said energizing does not cause fluid to be ejected from the print head.

25. The printing device of claim 24, wherein the controller is further configured to sufficiently energize at least one of the electrical components to cause at least a portion of the fluid to be ejected from the ejection chamber.

26. The printing device of claim 24, wherein the associated individual electrical component comprises a resistor.

27. The printing device of claim 24, wherein the associated individual electrical component comprises a piezoelectric crystal.

28. The printing device of claim 24, wherein at least some of the multiple electrical components comprise transistors.

29. A method comprising:

positioning a filter relative to a fluid supply path of a micro electro mechanical systems device so that fluid passes through the filter before reaching one or more ejection chambers of the micro electro mechanical systems device; and, configuring a processor to energize one or more electrical components at an intensity primarily selected to heat but not to vaporize the fluid, wherein the processor is configured to energize the electrical components in a pattern designed primarily to move a pre-existing bubble located between the electrical components and the filter to a location where the bubble can pass through the filter.

30. The method of claim 29, wherein said act of configuring moves the bubble in a direction generally opposite to the flow of the fluid through the filter.

31. The method of claim 29, wherein said act of positioning a filter comprises forming a patternable material over a substrate prior to forming a portion of the fluid-feed pat through the substrate, and further comprising patterning apertures in the patternable material.

32. The method of claim 29 further comprising the processor being configured to energize at least some of the electrical components at a second higher intensity primarily to vaporize at least a portion of the fluid.

33. One or more computer-readable media having computer-readable instructions thereon which, when executed, cause a micro electro mechanical systems device to:

energize a first electrical component at an intensity selected primarily to heat but not to vaporize fluid contained in the micro electro mechanical systems device; and, energize at least one different electrical component at an intensity selected primarily to heat but not to vaporize fluid contained in the micro electro mechanical systems device, wherein the first electrical component and the at least one different electrical component are energized in a pattern designed to move a bubble in a desired direction within the micro electro mechanical systems device.

34. One or more computer-readable media having computer-readable instructions thereon which, when executed by a micro electro mechanical systems device, cause the micro electro mechanical systems device to:

energize a first set of electrical components to eject fluid from the micro electro mechanical systems device; and, energize a second set of electrical components at an intensity selected primarily to heat but not to vaporize fluid contained in the micro electro mechanical systems device, wherein the second set of electrical components are energized in a pattern designed to move a bubble in a desired direction within the micro electro mechanical systems device.

35. A device comprising:

means for selectively ejecting fluid from a fluid-delivery device; and, means for heating fluid contained in the fluid-delivery device in a contaminant moving pattern designed to move a contaminant contained in the fluid-ejecting device without ejecting fluid from the fluid-delivery device.

36. The device of claim 35, wherein the means for ejecting also comprises the means for heating.

37. The device of claim 35, wherein the means for ejecting comprises a subset of the means for heating.

38. The device of claim 35, wherein the means for ejecting is different from the means for heating.

39. The device of claim 38 wherein the contaminant moving pattern moves the contaminant generally opposite to fluid flow along the fluid-supply path.

40. The device of claim 35 further comprising a means for filtering the fluid as the fluid travels along a fluid-supply path with the fluid-delivery device.

* * * * *

UNITED STATES PATENT AND TRADEMARK OFFICE

CERTIFICATE OF CORRECTION

PATENT NO. : 7,093,930 B2
APPLICATION NO. : 10/666749
DATED : August 22, 2006
INVENTOR(S) : Ozgur Yildirim et al.

It is certified that error appears in the above-identified patent and that said Letters Patent is hereby corrected as shown below:

In column 7, line 21, delete “826” and insert -- $826e_1$ --, therefor.

In column 12, line 67, in Claim 31, delete “pat” and insert -- path --, therefor.

Signed and Sealed this

Twenty-first Day of April, 2009

JOHN DOLL
*Acting Director of the United States Patent and Trademark Office*